US005239925A

United States Patent [19]

Bobo

[11] Patent Number: 5,239,925

[45] Date of Patent: Aug. 31, 1993

[54] INK DISTRIBUTION APPARATUS

[75] Inventor: Marion H. Bobo, Hickory, N.C.

[73] Assignees: Ronald L. Harper; James Richard Harper, both of Charlotte, N.C.

[21] Appl. No.: 892,169

[22] Filed: Jun. 2, 1992

[51] Int. Cl.[5] ..... B41F 31/04; B41F 31/06; B41F 31/08

[52] U.S. Cl. ..... 101/366; 101/169

[58] Field of Search ..... 101/366, 365, 363, 148, 101/207-210, 157, 169, 364; 118/258, 259, 261, 407, 410, 413

[56] References Cited

U.S. PATENT DOCUMENTS

| | | | |
|---|---|---|---|
| 2,018,193 | 10/1935 | Smith | 101/366 |
| 2,151,969 | 3/1939 | Henderson | 101/366 X |
| 4,009,657 | 3/1977 | Bonanno et al. | 101/157 |
| 4,139,613 | 2/1979 | Hefele | 101/157 |
| 4,735,144 | 4/1988 | Jenkins | 101/425 |
| 4,867,097 | 9/1989 | Foltz | 118/407 |
| 4,998,474 | 3/1991 | Hauer | 101/366 |
| 5,054,392 | 10/1991 | Greenwood | 101/169 |

*Primary Examiner*—J. Reed Fisher

*Attorney, Agent, or Firm*—Bell, Seltzer, Park & Gibson

[57] ABSTRACT

Apparatus for distributing ink or other fluid on the surface of a rotating roll in flexographic or gravure type printing equipment. The ink distributing apparatus includes a backplate, first, second and third blades affixed to the backplate and having edges that define points of an arc, a secondary reservoir defined by the backplate and first and second doctor blades, and a primary reservoir defined by the backplate and the second and third doctor blades which is adjacent to the secondary reservoir. Inlets are also provided for communicating a fluid into each reservoir at relatively low pressure. The edges of the blades may be placed in close proximity with a surface of a roll having a periphery corresponding to the arc defined by the blade edges. Thus, the apparatus may be used to distribute a quantity of fluid received within the reservoirs on the surface of the roll when the roll rotates past the apparatus.

18 Claims, 2 Drawing Sheets

INK DISTRIBUTION APPARATUS

The present invention relates to ink distribution devices for use with printing equipment. In particular, the invention relates to an apparatus for distributing ink or other printing fluid on the peripheral surface of a roll of the type used in printing equipment.

BACKGROUND OF THE INVENTION

Flexible media such as paper, plastic, other web or sheet products or the like are commonly imprinted with designs, text or other patterns through the use of ink or some other suitable fluid printing medium. Such printing is often accomplished with flexographic type printing equipment that may be used to spread a desired pattern of the ink or other fluid on the surface of the web or sheet material.

In flexographic printing, the ink or other printing fluid is transferred to the web or sheet material by a plate cylinder having a surface on which a design or pattern is formed. The ink is applied to the plate cylinder by a metering, or anilox roll, which generally has a plurality of relatively small chambers, or cells, distributed over its peripheral surface. The anilox roll may have a surface made of some suitable material, such as a ceramic coating or plating of hardened metal, for example. The cells may be formed in the surface of the anilox roll by engraving, machining or the like.

The peripheries of the anilox roll and plate cylinder contact each other so as to form a nip. This nip, or line of contact, between the anilox roll and plate cylinder permits the ink or other printing fluid to be transferred from the cells of the anilox roll to the plate cylinder.

To ensure high quality printing, it is essential that an even coat of ink first be applied to the anilox roll so that the anilox roll can distribute ink evenly over the surface of the plate cylinder. In the past, various means have been used to distribute ink over the anilox roll. These prior art devices generally fall into two categories, inkwells and fountain rolls. Each of these types of prior art apparatus is described below.

A. Prior Art Inkwells: One prior means uses a chamber having doctor blades positioned in close contact with the surface of the rotating anilox roll. The chamber defines a reservoir of ink that is held against the turning face of the anilox roll. The doctor blades retain the ink within the chamber so as to let the ink pass out of the chamber only when it is carried on the surface of the rotating anilox roll. When this system is used, the ink or other printing fluid is usually introduced into the sealed chamber at a relatively low pressure. One prior art apparatus of this type that has been used to distribute ink on an anilox roll is an apparatus sold by Printco Industries, Ltd. of Wisconsin.

Referring to the drawings, FIG. 1 illustrates a typical prior art apparatus of this type, indicated generally at 10. This prior art apparatus includes an ink well 11 which may contain a quantity of ink or other printing fluid, generally at relatively low pressure. The ink well 11 is in contact with an anilox or metering roll 12. The anilox roll 12 rotates, here shown in a clockwise direction, across the open face of the ink well 11. Thus, a quantity of ink 13 is maintained in contact with a portion of the peripheral surface of the anilox roll 12.

The ink is retained within the well 11 and is metered in a desired quantity on the surface of the anilox roll 12 by doctor blades 14 and 14*a*. Rotation of the anilox roll 12 carries the ink retained within the cells on the surface thereof past the blade 14 to a nip 15 formed between the anilox roll 12 and a plate cylinder 16. As shown in FIG. 1, the anilox roll 12 and plate cylinder 16 rotate in opposing directions so as to define a point of contact, or nip 15 therebetween. The ink is released from the cells on the surface of the anilox roll 12 and is transferred to the surface of the plate cylinder 16 at the nip 15.

FIG. 1 illustrates that this prior art apparatus has a relatively small enclosed wet cell angle 20 defined by the area of the periphery of the roll 12 that is retained against the ink well 13. In addition, a relatively large area 21 extends between the doctor blade 14 and the nip 15. This area 21 may be known as the empty cell dry angle. Last, a third region 22 of the surface of the anilox roll 12 extends between the nip 15 and the doctor blade 14*a*. This portion 22 is commonly known as the full cell dry angle.

The flexographic printing equipment utilizing the ink distributing apparatus shown in FIG. 1 is exemplary of many prior art applications in that it has an enclosed wet cell angle 20 of about 25°. The empty cell dry angle 21 may be about 155°, and the full cell dry angle 22 may be about 180°. The relative magnitudes of these angles 20, 21 and 22 may vary; however, the foregoing values are representative in that they show that the exposed full and empty cell dry angles 21 and 22 are generally far larger than the enclosed wet cell angle 20.

B. Fountain Rolls: An alternative prior art means for applying ink to a metering roll uses a fountain roll which rotates through an ink reservoir that is spaced apart from the anilox roll. The fountain roll, which is in contact with the anilox roll, is generally made of an absorbent or elastomeric material. Thus, the fountain roll may rotate through the ink reservoir, capture a quantity of ink or other printing fluid on its surface, and carry the ink to the anilox roll. A doctor blade is often located near the nip between the fountain and anilox rolls to remove excess ink or printing fluid that is deposited on the anilox roll by the fountain roll.

A partially schematic environmental view of one of these prior art apparatus 30 is shown in FIG. 2. An anilox roll 37 and a plate cylinder 31 are used, and a fountain roll 32 is used to lift a quantity of ink or other printing fluid 33 from a reservoir 34 to the anilox roll 37. The fountain roll 32 and anilox roll 30 rotate in opposite directions so as to form a nip, or point of constant contact, 35.

Still referring to FIG. 2, the surface of the anilox roll 37 rotates past the nip 35 to a doctor blade 36. The doctor blade 36 is positioned in close proximity to the peripheral surface of the anilox roll 37, often at an acute angle, as shown in FIG. 2. The doctor blade 36 removes excess ink that may have adhered to the peripheral surface of the anilox roll 37 as it passed beyond the nip 35.

Still referring to FIG. 2, the ink on the anilox roll 37 is carried past the doctor blade 36 to a nip 38 formed with the plate cylinder 31. As in the other prior art apparatus, the plate cylinder 31 and anilox roll 37 rotate in opposite directions, such that the ink carried in the cells on the anilox roll 37 contacts the plate cylinder 31 and is transferred thereto at the nip 38 Thereafter, rotation of the roll 37 conveys the emptied cells on the surface of the roll 37 so that they again reach the nip 35 to receive another application of ink from the fountain roll 32.

As shown in FIG. 2, this prior art apparatus has a wet cell angle 40 which extends from the nip 38 to the doctor blade 36. This portion of the rotation is known as the wet cell angle because the excess ink or other printing fluid has not yet been removed by the doctor blade 36. The wet cell angle 40 is exposed, generally, to the atmosphere, and it may vary considerably in size. In the example shown in FIG. 2, the exposed wet cell angle 40 is about 90°, or one quarter of the periphery of the roll 37.

An exposed full cell dry angle 41 is defined between the doctor blade 36 and the nip 38. In this example, the full cell dry angle 41 is about 150°. Last, an exposed empty cell dry angle 42 extends between the nip 38 and the nip 35. Again in this example, the empty cell dry angle is about 120°. All of these angles may vary in various prior art apparatus; however, the foregoing values are believed to be representative in that they show that nearly all of the surface of the roll 37 is exposed to atmospheric conditions.

These prior methods have been found useful in many applications. However, as noted previously, good printing quality depends, at least in part, on a uniform distribution of ink on the anilox roll and plate cylinder. For example, if uneven quantities of ink are transferred from the anilox roll to the plate cylinder, streaks or other poor printing results may show in the finished printed product. These problems have been found to be particularly apparent when thin plastic film materials such as polyethylene are printed in flexographic printing equipment.

One phenomenon that has been found to cause poor printing quality, particularly when flexographic apparatus is used to print plastic film, is associated with exposure of the ink or other printing fluid to ambient conditions. Since a relatively large portion of the periphery of the anilox rolls used in prior art printing equipment may be exposed to ambient atmospheric conditions, and because many inks and other printing fluids are relatively volatile, some portion, or all, of the ink or printing fluid may dry or become gummy while in the cells of the anilox roll. As a result, the cells may become clogged over time as the anilox roll 30 in operation. In some instances this drying problem occurs on the portion of the anilox roll surface that is between the doctor blade and the nip between the anilox roll and plate cylinder. Drying may also occur on the anilox roll surface extending between the plate cylinder nip and the fountain roll or inkwell.

The gummed or clogged cells carry less ink to the surface of the plate cylinder and may result in streaks or other poor printing characteristics. In particular, incomplete release of the ink or other printing medium may lead to "ghosting" of the printed medium, a condition which is characterized by the appearance or absence of a certain color or design on the medium being printed at undesired locations. "Ghosting" may occur because the anilox roll and plate cylinder generally do not have the same diameter and therefore turn at different rotational velocities, although the surfaces of the rolls do turn at the same speed so as to maintain a nonsliding point of contact.

For example, if the design surface on the plate cylinder does not contact a particular portion of the anilox roll during a first rotation, the ink in the cells of the anilox roll at that portion is not released to the plate cylinder. Because the anilox roll is exposed to ambient conditions for most of its rotation, the ink in those cells may become dried or gummed, thus occluding the cells. Since the occluded cells cannot pick up ink during their subsequent passes beyond the ink application means, they are unable to transport additional ink to the plate cylinder on subsequent rotations. As a result, the pattern of occluded, or clogged, cells may be transferred to the printed medium.

Other problems are associated with undesired drying of ink or printing fluid in the cells of the anilox roll. For example, gummed or dried ink material may also build up on the leading edge of the doctor blades associated with the anilox roll, which may result in increased wear of the blades and roll.

As a result of the foregoing difficulties, it is often necessary periodically to clean the cells of the anilox roll, thus resulting in down time of the printing equipment which reduces productivity and increases operating costs. Additionally, since gumming of the anilox roll cells may lead to increased doctor blade wear or roll wear, the roll and blades must be removed periodically so that the roll may be replaced or resurfaced and so that the doctor blade may be replaced. Other problems may also require correction from time to time.

The relatively large area of exposure of the ink-coated surface of the anilox roll may also present another difficulty, namely, the fire and health hazard presented by ambient exposure of ink or other printing fluids. The inks or printing fluids that are in common use with modern printing equipment often have volatile, petrochemical based solvents or components. Such materials may be highly flammable, and they may also be carcinogenic or otherwise hazardous to the health of persons who work with the printing equipment or in areas adjacent thereto. An additional problem may result from air becoming entrapped in the cells of the anilox roll thus blocking a new supply of ink from being delivered to the cells. This problem may be exacerbated in ceramic coated rolls having relatively slick surfaces. Thus, it is essential to force the air out of the cells to permit new ink to be fed to the cells for transport to the plate cylinder.

Similar problems to those described hereinabove may also occur in gravure and other types of printing equipment.

One prior art patent that shows an inking unit is U.S. Pat. No. 4,998,474, issued to Hauer on Mar. 12, 1991. The Hauer '474 patent shows a plurality of ink wells and doctor blades. However, the apparatus shown in this patent does not significantly reduce the portion of the anilox roll that carries ink that is exposed to atmospheric conditions. Another prior apparatus is shown in U.S. Pat. No. 2,151,969, issued to C.L. Henderson on Mar. 28, 1939. However, this apparatus likewise does not show a significant covering of the surface of the print roll, and it is not intended for use with anilox rolls of the type used in flexographic printing but is instead used for rotogravure type equipment. Another reservoir for applying ink to a roll is shown in U.S. Pat. No. 4,009,657, issued to Bonanno et al. on Mar. 1, 1977. However, none of these prior apparatus are believed to have been satisfactory in solving the problems described herein.

In light of the aforementioned deficiencies, it is an object of the present invention to provide a new ink distributing apparatus for use with anilox or gravure rolls which provides improved printing characteristics.

Another object of the present invention is to provide an ink distributing apparatus which provides for even distribution of ink on a metering roll such as an anilox or gravure roll.

Still another object of the present invention is to provide an ink distributing apparatus for use with printing equipment which reduces the exposed area of the full and dry cells of an anilox roll to reduce gumming or clogging of the cells in the anilox roll.

A further object of the present invention is to provide an ink distributing apparatus which forces undesired air from the cells of the metering roll to permit a new supply of ink to be delivered to the cells.

Yet another object of the present invention is to provide an ink distributing apparatus which reduces doctor blade wear.

A still further object of the present invention is to provide an anilox roll ink distributing apparatus which reduces the down time necessary for replacing, repairing or cleaning anilox rolls and doctor blades.

SUMMARY OF THE INVENTION

The above and other objects and advantages of the present invention are achieved in the embodiment described herein of an apparatus for distributing an ink or other fluid on the surface of a rotating roll in printing equipment such as flexographic or gravure printing equipment. The ink distributing apparatus includes a backplate, and first, second and third blades affixed to the backplate and having edges that define points of an arc. The backplate and first and second blades define a secondary ink reservoir. A primary reservoir adjacent to the secondary reservoir is defined by the backplate and the second and third blades. Inlets are provided for communicating a fluid such as ink into each reservoir at relatively low pressure. The edges of the blades are placed in close proximity with a surface of a roll having a periphery corresponding to the arc defined by the blade edges. Thus, the apparatus may be used to distribute a quantity of fluid received within the reservoirs on the surface of the roll when the roll rotates past the apparatus. In a preferred embodiment, the secondary reservoir defines a secondary enclosed wet cell angle of at least about 75° or greater, and most advantageously, of at least about 80°. Also in a preferred embodiment, the primary reservoir defines a primary enclosed wet cell angle of at least about 5°, and most advantageously, of at least about 30°. In a preferred embodiment, the total enclosed wet cell angle is at least about 100°, and in one particularly preferred embodiment, of about 115°. Consequently, the exposed full and empty cell dry angle portions of the anilox roll are significantly reduced, and undesired air is removed from the cells.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate prior ar apparatus and a preferred and exemplary embodiment of the invention, and wherein.

DESCRIPTION OF THE PREFERRED EMBODIMENT

Figure 3:
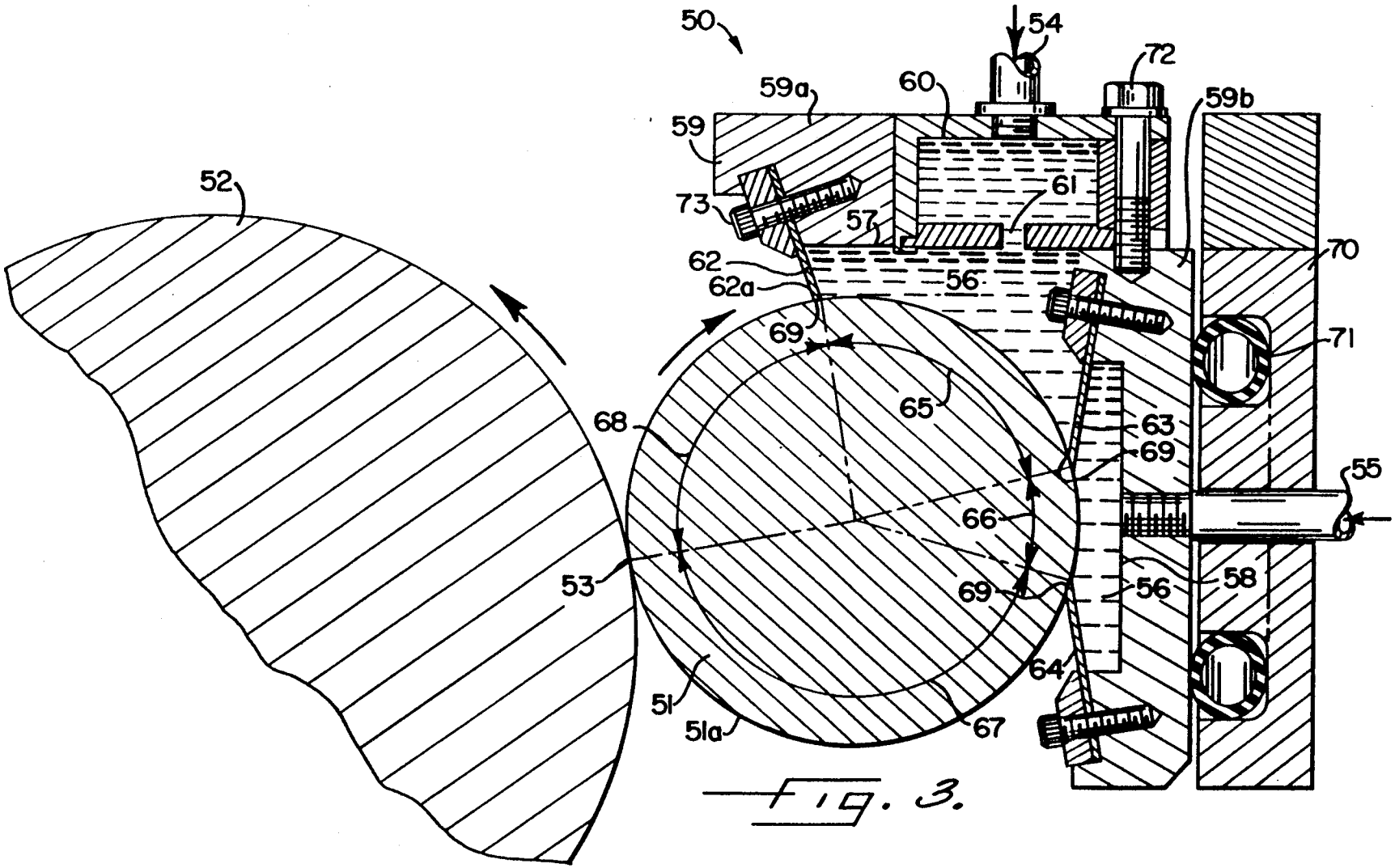
FIG. 3 is an environmental end elevation view of one preferred embodiment of an ink distributing apparatus made in accordance with the present invention.

Referring now to FIG. 3, one preferred embodiment of an anilox roll ink distributing apparatus made in accordance with the present invention is designated generally at 50. The apparatus 50 is shown in use with an anilox roll 51, which may be of the type commonly used that has a peripheral surface 51*a* that is covered With cells for carrying ink or other printing fluid. The apparatus 50 may also be used in conjunction with gravure type printing equipment, and may also be suitable for distributing ink or other fluids over rolls in other types of printing equipment.

As shown in FIG. 3, the anilox roll 51 further contacts a plate cylinder 52. The anilox roll 51 and plate Cylinder 52 rotate in opposite directions so as to define a nip, or point of constant, non-sliding contact 53. FIG. 3 illustrates the anilox roll 51 turning clockwise and the plate cylinder 52 turning counterclockwise. Ink or other printing fluid carried on the anilox roll 51 is transferred to the plate cylinder 52 at the nip 53.

The apparatus 50 includes a backplate 59, Which may be made of two panels 59*a* and 59*b*, and a first doctor blade 62, a second doctor blade 63 and a third doctor blade 64 which extend from the backplate 59. A greater number of blades may be used depending on the number of reservoirs that are defined by the apparatus 50, however, it is essential that at least three blades be used, thus defining two adjacent reservoirs, to achieve improved removal of trapped air from the cells on the anilox roll surface, and thereby, to improve transfer of ink into the cells.

Each of the blades 62, 63 and 64 have edges 69 that are suited for contacting or being positioned in close proximity to the moving surface of an anilox or other roll 51. The edges 69 are aligned along an arc so that they generally correspond to the peripheral surface 51*a* of the anilox roll 51.

The backplate 59*a*, first blade 62 and second blade 63 define a secondary reservoir 57. Likewise, the second blade 63, third blade 64 and backplate 59*b* define a primary reservoir 58. In the preferred embodiment, the reservoirs 57 and 58 are adjacent each other and are separated by the second blade 63.

The first blade 62 may advantageously be positioned so that its edge 69 contacts the surface of the roll 51, or if the roll 51 is rotating in the direction shown in FIG. 3, the blade 62 may be spaced about one-ten thousandth of an inch from the surface of the anilox roll 51 to retain the ink 56 within the secondary reservoir 57. This slight Spacing is helpful in preventing unwanted buildup of unwanted ink material on the leading side 62*a* of the blade 62.

In a preferred embodiment, the first blade 62 may be made of relatively hard metal such as steel, although other materials such as plastic may be used. The first blade 62 may be positioned at an angle of between about 38° and 45° relative to a tangent of the arc corresponding to the surface 51*a* of the roll 51 so that the blade 62 is inclined toward the secondary reservoir 57. It has been found to be of particular advantage to set the blade 62 at an angle of about 38°.

The second blade 63 separates the secondary and primary chambers 57 and 58. The second blade 63 is preferably made of hard plastic, although metal or other material may also be used. The second blade 63 is preferably positioned at an angle of between about 25° and 30° off tangent relative to the arc that corresponds to the surface of the anilox roll 51 so that the blade 63 is inclined toward the primary reservoir 58. A wider range of settings may also be used, varying between about 15° and 50° off tangent, as conditions require. In a preferred embodiment, the blade 63 is positioned at an angle of about 25° measured relative to the tangent of the arc or periphery of the roll 51, and is maintained in contact against the surface of the roll 51, as described hereinbelow.

The third blade 64 is placed at the downstream side of the primary chamber 58. The blade 64 thus retains the ink 56 within the primary enclosed chamber 58 and acts to meter the ink 56 evenly across the surface of the anilox or other roll 51. In a preferred embodiment, the blade 64 is set at an angle of between about 10° and 40° off tangent of the arc to which the surface of the anilox roll 51 corresponds so that the blade 64 is inclined toward the primary reservoir 58. More preferably, this angle may be fixed at between about 20° and 25° off tangent. Good results have been found with a setting of about 25° for the blade 64.

The blade 64 may, be made of a relatively hard polymeric material such as plastic, although other materials such as metal or the like may be substituted. In a preferred embodiment, the blade 64 contacts the surface of the anilox roll 51 to provide for accurate metering.

The apparatus 50 may be used in conjunction with a roll 51 turning in either direction. Thus, the roles of each reservoir 57 and 58 and the blades 62, 63 and 64 would be reversed if the roll 51 were turned in a counterclockwise direction.

Still referring to FIG. 3, means is provided for communicating ink or other printing fluid 56 into the apparatus 50. In a preferred embodiment, inlets 54 and 55 lead into the backplate 59 to provide for introduction of a quantity of ink or other fluid into the secondary reservoir 57 and primary reservoir 58, respectively.

In one preferred embodiment, a manifold 60 is defined in the backplate 59*a* in the upper regions of the secondary reservoir 57 for evenly distributing the ink 56 along the length of the anilox roll 51. The manifold 60 may include a plurality of spaced apart openings 61 formed along the axial length of the reservoir 57. It has been found that inclusion of a manifold 60 assists in even distribution of the ink 56 over the length of the anilox roll 51. A manifold 60 may also be used in conjunction with the primary reservoir 58, if desired.

In the preferred embodiment, ink is introduced into the reservoirs 57 and 58 at relatively low pressures. The ink may be introduced into the secondary reservoir 57 at between about 1-2 psi. A greater range of pressures may be used, varying from ambient pressure to 3 psi or even higher in certain applications. This range of pressures may also be used for the ink or other printing fluid introduced into the primary reservoir 58. However, in one particularly preferred embodiment, the ink 56 is introduced into the primary reservoir 58 at a pressure of about 1 psi.

The apparatus 50 has been found to substantially improve printing that is accomplished with equipment that uses anilox or gravure rolls. Since the apparatus 50 covers a relatively large portion of the surface area of the roll 51, its use substantially reduces the exposed full and empty cell dry angles associated with rotation of the roll 51. For example, in the embodiment illustrated in FIG. 3, the enclosed secondary reservoir 57 defines a secondary enclosed wet cell angle 65 of about 85°, as measured between the edges 69 of the blades 62 and 63 over the arc corresponding to the surface of the roll 51. A primary enclosed wet angle 66 is defined by the primary enclosed reservoir 58 as measured between the points of contact of the blades 63 and 64. In the preferred embodiment shown in FIG. 3, the primary enclosed wet cell angle 66 is about 30°. Thus, the cumulative enclosed wet cell angle between the blades 62 and 64 is at least about 100°, and preferably at least about 115°. The cumulative enclosed wet cell angle may be much greater, depending largely on the space limitations of the printing equipment in which the apparatus 50 is installed. It is contemplated that the cumulative enclosed wet cell angle may practically be increased to at least about 300° of the surface of the roll 51.

The enclosed wet cell angles 65 and 66 set forth above may be increased or decreased relative to each other as necessary, and may be increased or decreased to accommodate existing printing equipment. The cumulative enclosed wet cell angles 65 and 66 may also be increased or decreased so long as sufficient wet cell coverage of the roll 51 is ensured to achieve the advantages of the invention. For example, it has been found that the primary enclosed wet cell angle 66 may be reduced so that it is at least about 5° but it may be increased to a much higher size. Likewise, the secondary enclosed wet cell angle 65 may be reduced so that it is at least about 75°, but this too may be increased to a much greater size.

Figure 1:
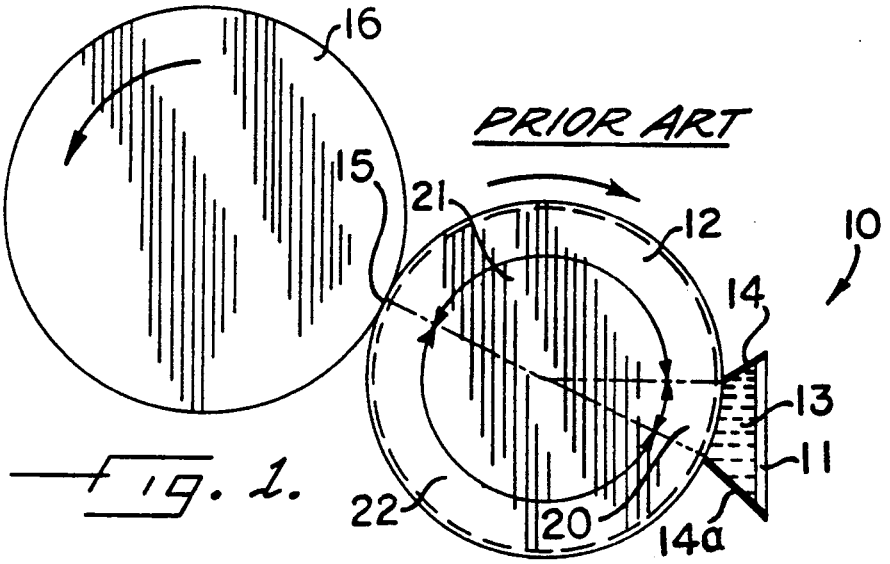
FIG. 1 is a partially schematic end elevation view of one prior art inking apparatus.
Figure 2:
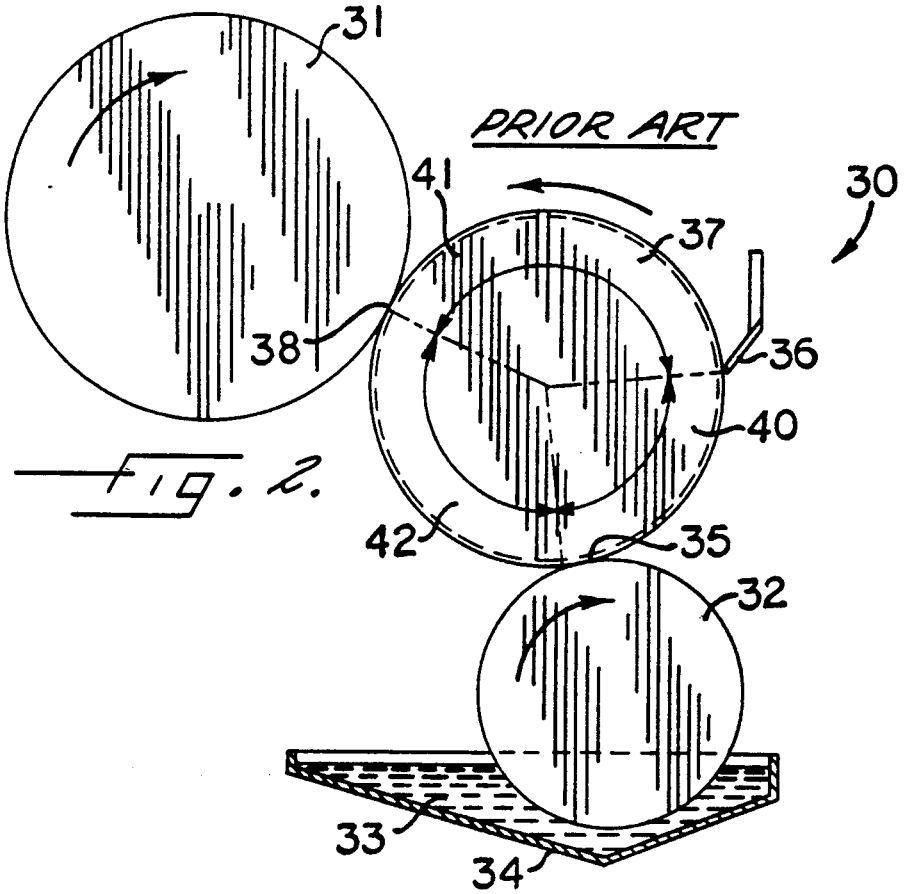
FIG. 2 is a partially schematic end elevation view of yet another prior art inking apparatus.

As a result of the relatively large secondary and primary enclosed wet cell angles 65 and 66, the exposed empty cell dry angle 68 is substantially reduced from that which is usually found in the prior art ink distributing apparatus, such as the prior art apparatus shown in FIGS. 1 and 2. For example, in the embodiment shown in FIG. 3, the exposed empty cell dry angle 68, which extends between nip 53 and the blade 62 is about 90°. Also in FIG. 3, the exposed full cell dry angle 67 defined between the blade 64 and the nip 53 is about 155°.

Moreover, the cumulative enclosed wet cell angle 65 and 66 of the present invention is far greater than the wet cell angles which result from use of the prior art apparatus shown in FIGS. 1 and 2. The cumulative dry cell angles 67 and 68 that result from the present invention are consequently reduced relative to the cumulative dry cell angles that result from use of the prior art apparatus shown in FIGS. 1 and 2.

As noted above, the two adjacent secondary and primary enclosed reservoirs 57 and 58 cover a relatively large portion of the anilox, gravure or other roll 51, thus substantially modifying the effectiveness of the distribution of the ink 56 over the surface of the roll 51 and substantially reducing the exposed cell angles 67 and 68. Thus, the problem of drying ink or other printing fluids within the exposed cells on the roll 51, particularly in the region 68, is greatly reduced or altogether alleviated. Also, the safety and health hazard associated in using such printing equipment is significantly reduced since the volatile inks or other printing fluids are not exposed to ambient conditions as long as they otherwise would be in prior art printing apparatus.

Because the blades 62, 63 and 64 are in close proximity or actual sliding contact with the anilox roll 51, some wear of the blades is to be expected. As a result, occasional adjustment of the apparatus 50 may be necessary to ensure that the blades 62, 63 and 64 remain in an appropriate position relative to the surface of the roll 51. To reduce the frequency in which manual adjustments must be made and to increase the accuracy of metering of the ink from the apparatus 50 onto the roll 51, automatic position adjustment means such as the pneumatic apparatus 70 may be provided.

In a preferred embodiment, the pneumatic position adjustment apparatus 70 may be of a type known in the art which includes an air bladder 71 that is pressurized at a constant, predetermined pressure. The bladder 71 may be pressurized to between about 5 and 20 psi. In a particularly preferred embodiment, a pressure of between about 10 and 14 psi is used. In alternative embodiments, the pneumatic apparatus 70 may be replaced by a hydraulic apparatus or other means for urging the blades 63 and 64 against the surface of the roll 51. The positioning of the blade 62 by manual adjustment of the fastener screw 73 may also occasionally be necessary.

Apparatus 50 also includes end seals (not shown) located at the lateral ends of the roll 51 for retaining the ink 56 within the reservoirs 57 and 58. The end seals my be of the type readily known to those skilled in the art, and may be made of plastic or other suitable materials to prevent seepage of the slightly pressurized ink from the chambers 57 and 58.

The present invention has been found particularly useful when used in conjunction with relatively hard ceramic-coated anilox rolls 51, which typically have relatively fine cells defined on the peripheral surfaces thereof. As a result, it is more difficult for the ink to be applied to the cells or to be released from the cells. For example, air may become entrapped within the cells. The blade 63 helps remove this undesirable air so that ink may be fed into the cells. Also, since a greater portion of the periphery of the roll 51 is covered by the present invention, the apparatus 50 aids in urging the ink into the cells to fill them. Likewise, by reducing the full and empty dry cell angles, these relatively smaller cells are not as susceptible to clogging.

The present invention has also been found particularly effective in preventing the phenomenon as "ghosting" when printing on web or sheet material. Additionally, it is believed that the use of two enclosed reservoirs 57 and 58 has a lubrication aspect which may lengthen the life of the roll 51, and that the enclosed reservoirs 57 and 58 also have a cooling effect which keeps the roll 51 cooler during high speed operation of the printing equipment.

The present invention may be used in conjunction with anilox rolls used in conjunction with lithographic printing equipment, and it is contemplated that the invention may be used with gravure or other types of printing equipment in which a quantity of ink or other printing fluid must be distributed evenly over the surface of a rotating roll. The printing fluid may include inks, although the invention may also be suitable for use in distributing adhesives or other coating compounds over the surface of rotating rolls.

In alternative embodiments, a greater number of reservoirs such as the reservoirs 57 and 58 may be used to achieve the advantages of the invention so long as an appropriate number of doctor blades or other means is provided to divide the reservoirs, to ensure increased wet cell angle coverage and decreased exposed dry cell angles on the roll 51, and so that at least one interiorly positioned blade 63 is included. However, division of the apparatus 50 into two reservoirs 57 and 58, as shown herein, is believed to be suitable for many applications. If too many reservoirs are used, the accordingly increased number of blades may accelerate wear of the roll 51 and increase the heat that is generated by sliding contact between the edges of the blades and the rotating roll.

The invention may also be achieved by provision of an attachment for modification of existing printing equipment having an ink well of the type shown in FIG. 1. In this embodiment, the backplate panel **59*a* that defines the secondary reservoir 57 may be attached to an existing inkwell associated with the backplate panel 59*b* by screws or other fasteners 72. Thus, the panels 59*a* and 59*b*** may be at right angles to each other.

In the drawings and specification, there has been disclosed a typical preferred embodiment of the invention. Although specific terms have been employed, they have been used in a generic and descriptive sense only and not for purposes of limitation, the scope of the invention being set forth in the following claims.

What is claimed is:

1. Apparatus for distributing fluid inks, comprising:

a roll having a longitudinal axis of rotation, a cylindrical surface, and a plurality of cells defined in said cylindrical surface for receiving ink;

a backplate disposed parallel to said longitudinal axis and overlying said cylindrical surface of said roll;

first, second and third blades affixed to said backplate generally parallel to said longitudinal axis of said roll, said first, second and third blades extending between said backplate and said cylindrical surface;

said second and third blades having edges in contact with said cylindrical roll surface;

said cylindrical surface, backplate and second and third blades defining a primary reservoir for receiving a quantity of ink and covering at least about 30° of said cylindrical surface of said roll;

said cylindrical surface, backplate and first and second blades defining a secondary reservoir adjacent said primary reservoir for receiving a quantity of ink, said secondary reservoir covering at least about 85° of said cylindrical surface of said roll; and means for separately charging each said primary and secondary reservoir with pressurized ink, whereby ink within said reservoirs may be distributed on said cylindrical surface of said roll when said roll rotates past said blades, and further whereby the portion of said cylindrical surface that is exposed to ambient conditions is reduced, thereby reducing drying of ink within said cells of said roll.

2. Apparatus as defined in claim 1 wherein said primary and secondary reservoirs cumulatively cover at least about 300° of said cylindrical roll surface.

3. Apparatus as defined in claim 1 wherein said first blade has an edge in contact with said cylindrical roll surface.

4. Apparatus as defined in claim 1 wherein said first blade is inclined toward said secondary reservoir at an angle of between about 38° and 45° relative to a tangent from said cylindrical surface.

5. Apparatus as defined in claim 4 wherein said second blade is inclined toward said primary reservoir at an angle of between about 1520 and 50° relative to a tangent from said cylindrical surface.

6. Apparatus as defined in claim 5 wherein said third blade is inclined toward said primary reservoir at an angle of between about 1020 and 40° relative to a tangent from said cylindrical surface.

7. Apparatus as defined in claim 6 wherein said first blade is inclined at an angle of about 38°, wherein said second blade is inclined an angle of about 25°, and wherein said third blade is inclined an angle of about 25°.

8. Apparatus as defined in claim 6 wherein said means for charging said reservoirs with ink is adapted to charge said reservoirs with ink at a pressure of less than about 3 pounds per square inch.

9. Apparatus as defined in claim 8 further comprising a manifold for evenly distributing fluid ink across each said reservoir.

10. Apparatus as defined in claim 9 wherein said manifold is adapted to charge each said reservoir with ink at a pressure of about 1 psi.

11. Apparatus for distributing fluid inks, comprising;

a roll having a longitudinal axis of rotation, a cylindrical surface, and a plurality of cells defined in said cylindrical surface for receiving ink;

a backplate disposed parallel to said longitudinal axis and overlying said cylindrical surface of said roll;

first, second and third blades affixed to said backplate generally parallel to said longitudinal axis of said roll, said first, second and third blades extending between said backplate and said cylindrical surface;

said second and third blades having edges in contact with said cylindrical roll surface;

said cylindrical surface, backplate and second and third blades defining a primary reservoir for receiving a quantity of ink and covering at least about 30° of said cylindrical surface of said roll;

said cylindrical surface, backplate and first and second blades defining a secondary reservoir adjacent said primary reservoir for receiving a quantity of ink;

said primary and secondary reservoirs cumulatively covering at least about 115° of said cylindrical surface; and a manifold for independently and evenly charging each said primary and secondary reservoir with pressurized ink at a pressure of less than about 3 psi, whereby ink within said reservoirs may be distributed on said cylindrical surface of said roll when said roll rotates past said blades, and further whereby the portion of said cylindrical surface that is exposed to ambient conditions is reduced, thereby reducing drying of ink within said cells of said roll.

12. Apparatus as defined in claim 11 wherein said primary and second reservoirs cumulatively cover at least about 300° of said cylindrical surface.

13. Apparatus as defined in claim 12 wherein said first blade is inclined toward said secondary reservoir at an angle of between about 38° and 45° relative to a tangent from said cylindrical surface, wherein said second blade is inclined toward said primary reservoir at an angle of between about 15° and 50° relative to a tangent from said cylindrical surface, and wherein said third blade is inclined toward said primary reservoir at an angle of between about 10° and 40° relative to a tangent from said cylindrical surface.

14. Apparatus as defined in claim 13, wherein said first blade is inclined at an angle of about 38°, wherein said second blade is inclined an angle of about 25°, and wherein said third blade is inclined an angle of about 25°.

15. Apparatus for distributing fluid inks, comprising:

a roll having a longitudinal axis of rotation, a cylindrical surface, and a plurality of cells defined in said cylindrical surface for receiving ink;

a backplate disposed parallel to said longitudinal axis and overlying said cylindrical surface of said roll;

first, second and third blades affixed to said backplate generally parallel to said longitudinal axis of said roll, said first, second and third blades extending between said backplate and said cylindrical surface;

said second and third blades having edges in contact with said cylindrical roll surface;

said cylindrical surface, backplate and second and third blades defining a primary reservoir for receiving a quantity of ink and covering at least about 30° of said cylindrical surface;

said cylindrical surface, backplate and first and second blades defining a secondary reservoir adjacent said primary reservoir for receiving a quantity of ink;

said adjacent primary and secondary reservoirs cumulatively covering at least about 300° of said cylindrical surface of said roll; and a manifold for independently charging each said primary and secondary reservoir with pressurized ink at a pressure of about 1 psi, whereby ink within said reservoirs may be distributed on said cylindrical surface when said roll rotates past said blades, and further whereby the portion of said cylindrical surface that is exposed to ambient conditions is reduced, thereby reducing drying of ink within said cells of said roll.

16. Apparatus as defined in claim 15 wherein said first and third blades have edges in contact with said cylindrical surface.

17. Apparatus as defined in claim 15 wherein said first blade is inclined toward said secondary reservoir at an angle of between about 38° and 45° relative to a tangent from said cylindrical surface, wherein said second blade is inclined toward said primary reservoir at an angle of between about 15 and 50° relative to a tangent from said cylindrical surface, and wherein said third blade is inclined toward said primary reservoir at an angle of between about 10° and 40° relative to a tangent from said cylindrical surface.

18. Apparatus as defined in claim 17, wherein said first blade is inclined at an angle of about 38°, wherein said second blade is inclined an angle of about 25°, and wherein said third blade is inclined an angle of about 25°.

* * * * *

UNITED STATES PATENT AND TRADEMARK OFFICE

CERTIFICATE OF CORRECTION

PATENT NO. : 5,239,925

DATED : August 31, 1993

INVENTOR(S) : Bobo

It is certified that error appears in the above-identified patent and that said Letters Patent is hereby corrected as shown below:

Col. 2, Line 64 after "38" insert --.--.

Col. 3, Line 44 after "instances" insert --,--.

Col. 5, Line 59 "ar" should be --art--.

Col. 6, Line 9 "With" should be --with--.

Col. 6, Line 17 "Cylinder" should be --cylinder--.

Col. 6, Line 23 "Which" should be --which--.

Col. 6, Line 52 "Spacing" should be --spacing--.

UNITED STATES PATENT AND TRADEMARK OFFICE
CERTIFICATE OF CORRECTION

PATENT NO. : 5,239,925

DATED : August 31, 1993

INVENTOR(S) : Bobo

It is certified that error appears in the above-identified patent and that said Letters Patent is hereby corrected as shown below:

In the Claims:

Col. 10, Line 61 "1520" should be --15°--.

Col. 10, Line 65 "1020" should be --10°--.

Col. 11, Line 26 after "said" insert --first,--.

Col. 11, Line 27 after "cylindrical" delete --roll--.

Col. 12, Line 19 delete "and third".

Col. 12, Line 19 "blades" should be --blade--.

Col. 12, Line 19 after "having" insert --an--.

Col. 12, Line 19 after "edges" should be --edge--.

Col. 12, Line 49 "15" should be --15°--.

Signed and Sealed this

Twenty-second Day of March, 1994

*Attest:*

Bruce Lehman

BRUCE LEHMAN

*Attesting Officer*

*Commissioner of Patents and Trademarks*